US007538276B2

(12) United States Patent
Narumi

(10) Patent No.: US 7,538,276 B2
(45) Date of Patent: May 26, 2009

(54) FLAT-SHAPED CABLE

(75) Inventor: Yuji Narumi, Hanno (JP)

(73) Assignee: Junkosha Inc., Fukuda, Kasama-Shi, Ibaraki-Ken (JP)

( * ) Notice: Subject to any disclaimer, the term of this patent is extended or adjusted under 35 U.S.C. 154(b) by 0 days.

(21) Appl. No.: 11/571,470

(22) PCT Filed: Jun. 28, 2005

(86) PCT No.: PCT/JP2005/012284

§ 371 (c)(1),
(2), (4) Date: Dec. 29, 2006

(87) PCT Pub. No.: WO2006/004074

PCT Pub. Date: Jan. 12, 2006

(65) Prior Publication Data

US 2007/0175652 A1 Aug. 2, 2007

(30) Foreign Application Priority Data

Jul. 1, 2004 (JP) ..... 2004-195544

(51) Int. Cl.
*H01B 7/08* (2006.01)

(52) U.S. Cl. ..... 174/117 F

(58) Field of Classification Search ..... 174/117 F, 174/117 FF

See application file for complete search history.

(56) References Cited

U.S. PATENT DOCUMENTS

| | | | | |
|---|---|---|---|---|
| 3,082,292 | A * | 3/1963 | Gore | 174/117 F |
| 3,802,974 | A * | 4/1974 | Emmel | 156/55 |
| 4,443,657 | A * | 4/1984 | Hill et al. | 174/110 FC |
| 4,567,321 | A * | 1/1986 | Harayama | 174/117 F |
| 4,589,584 | A * | 5/1986 | Christiansen et al. | 228/111.5 |
| 6,766,578 | B1 * | 7/2004 | Swanson et al. | 29/868 |

FOREIGN PATENT DOCUMENTS

JP 02-236909 * 9/1990

* cited by examiner

*Primary Examiner*—Chau N Nguyen
(74) *Attorney, Agent, or Firm*—Collen IP; Donald J. Ranft

(57) ABSTRACT

In a flat-shaped cable in which many conductors or transmission lines arranged side by side are covered with and held between insulators or sheaths, the insulators or the sheaths are made of non-sintered or semi-sintered polytetrafluoroethylene, and are sintered and joined at web portions where the insulators or the sheaths are connected through the conductors or the transmission lines, and therefore, even if it is formed by using a PTFE sheet or an EPTFE sheet as an insulator or a sheath of the flat-shaped cable such as a flat cable, the flat-shaped cable can be made to have excellent bendability, flexibility or pliability, as well as excellent slidability.

2 Claims, 1 Drawing Sheet

FLAT-SHAPED CABLE

TECHNICAL FIELD

The present invention relates to a flat-shaped cable, and particularly to a flat-shaped cable in which a polytetrafluoroethylene (hereinafter referred to as PTFE) sheet (tape) or an expanded porous polytetrafluoroethylene (hereinafter referred to as EPTFE) sheet (tape) is used as an insulator or a sheath.

BACKGROUND ART

Hitherto, for example, in order to electrically connect a movable part and a fixed part of a stepper of a semiconductor manufacture apparatus, a flat-shaped cable such as a flat cable is used, and in this flat-shaped cable, from the viewpoint of excellent electric characteristics such as a low dielectric constant, or heat resistance, chemical resistance or out gas measure, a PTFE sheet or an EPTFE sheet is used as an insulator or a sheath. The flat-shaped cable in which the PTFE sheet or the EPTFE sheet is used as the insulator or the sheath as stated above is formed in such a manner that for example, as disclosed in U.S. Pat. No. 3,082,292, transmission lines, such as conductors or coaxial cables, are supplied into respective grooves of a grooved compression roll having the many grooves, the many transmission lines, such as the conductors or coaxial cables, are arranged in parallel to each other, PTFE sheets or EPTFE sheets are also supplied from both sides of these supplied conductors or transmission lines, and these conductors or transmission lines are covered with and held between the PTFE sheets or the EPTFE sheets (insulating layers or sheaths) from both the sides, and then, the PTFE sheets or the EPTFE sheets at both the sides of the conductors or transmission lines are sintered at a sintering temperature of 327° C. or higher by a high temperature sintering bath (baking furnace) or the like, so that they are joined and formed.

In the flat-shaped cable formed in this way, various problems have arisen when the PTFE sheets or the EPTFE sheets are sintered by the high temperature sintering bath. That is, there are problems that since the PTFE sheets or the EPTFE sheets are shrunken at the time of the sintering, it is difficult to keep a distance (pitch) between the respective conductors of the flat-shaped cable or between the transmission lines with necessary accuracy, or since the PTFE sheets or the EPTFE sheets are hardened by the sintering, the bendability, flexibility, pliability or slidability of the flat-shaped cable becomes inferior.

Besides, since the flat-shaped cable is influenced by the high temperature of the sintering bath when the PTFE sheets or the EPTFE sheets are sintered, although there is no problem in the case where the conductor (soft copper) is silver plated or nickel plated, in the case where the conductor (soft copper) is tin plated, there is a case where the color of the conductor (soft copper) is changed, disconnection becomes liable to occur, and it can not be used as the cable.

Besides, in the flat-shaped cable, such as a flat cable, in which the PTFE sheets or the EPTFE sheets are used as the insulators or the sheaths as stated above, in the case where many coaxial cables or multi-core cables, as the transmission lines, are arranged side by side to form the flat-shaped cable, when the PTFE sheets or the EPTFE sheets are sintered by the high temperature sintering bath, in the case where the coaxial cables are used, the center conductor of the coaxial cable can kink, and as a result, there can occur a problem in electric characteristics, such as poor voltage resistance or poor characteristic impedance, and there can arise a problem that disconnection also becomes liable to occur.

DISCLOSURE OF THE INVENTION

Accordingly, the invention has been made in view of the above, and its object is to provide a flat-shaped cable in which even if it is formed by using a PTFE sheet or an EPTFE sheet as an insulator or a sheath of the flat-shaped cable such as a flat cable, it has excellent bendability, flexibility or pliability, and has excellent slidability.

Another object of the invention is to provide a flat-shaped cable in which in the flat-shaped cable such as a flat cable, even in the case where many coaxial cables or multi-core cables are arranged side by side as transmission lines, and a PTFE sheet or an EPTFE sheet is used as a sheath of the flat-shaped cable, in the case where the coaxial cables are used, the center conductor of the coaxial cable does not kink, poor electric characteristics such as poor voltage resistance or poor characteristic impedance do not occur, and further, disconnection also hardly occurs.

The objects of the invention are achieved by a flat-shaped cable of the invention. That is, in summary, the invention is a flat-shaped cable in which many conductors or transmission lines arranged side by side are covered with and held between insulators or sheaths, the insulators or the sheaths are made of non-sintered or semi-sintered polytetrafluoroethylene, and are sintered and joined at web portions where the insulators or the sheath are connected through the conductors or the transmission lines. Besides, the invention is the flat-shaped cable characterized in that the transmission lines are coaxial cables or multi-core cables.

According to the flat-shaped cable of the invention, in the flat-shaped cable in which the many conductors or transmission lines arranged side by side are covered with and held between the insulators or the sheaths, the flat-shaped cable is characterized in that the insulators or the sheaths are made of non-sintered or semi-sintered polytetrafluoroethylene, and are sintered and jointed at the web portions where the insulators or the sheaths are connected through the conductors or the transmission lines, and therefore, in the flat-shaped cable of the invention, unlike a past case, it is not performed that the whole flat-shaped cable is immersed in a high temperature sintering bath and the whole sheath is sintered in order to hold and fix transmission lines, such as conductors or coaxial cables, of the flat-shaped cable, only the web portions necessary to firmly hold and fix the conductors or the transmission lines at specified positions are sintered, and in the general sheaths to cover and hold the conductors or the transmission lines of the flat-shaped cable, EPTFE or PTFE is kept in the non-sintered state and the semi-sintered state, and accordingly, the PTFE sheets or the EPTFE sheets are not shrunken at the time of sintering, and a pitch between the respective conductors of the flat-shaped cable or between the respective transmission lines can be kept with sufficient accuracy.

Further, as described above, in the general sheaths, since EPTFE or PTFE is kept in the non-sintered state or the semi-sintered state, the PTFE sheets or the EPTFE sheets are not hardened by the sintering, the flexibility, pliability or slidability of EPTFE or PTFE in the non-sintered state or the semi-sintered state is not damaged, and the bendability, flexibility, pliability or slidability of the flat-shaped cable can be excellently kept. Thus, in the flat-shaped cable of the invention produced in this way, since the flexibility, pliability or slidability of EPTFE or PTFE in the non-sintered state or the semi-sintered state is not damaged, there is also an effect that the weakness in the twistability of a conventional flat-shaped cable is overcome and superior twistability is exhibited.

Besides, also in the case where the coaxial cable is used as the transmission line, the center conductor of the coaxial cable does not kink, and accordingly, there does not arise a problem in electric characteristics, such as poor voltage resistance or poor characteristic impedance, and there does not arise a problem that disconnection becomes liable to occur. Further, since the flat-shaped cable of the invention does not use a high temperature sintering bath, not only in the case where the conductor (soft copper) is silver plated or nickel plated, but also in the case where the conductor (soft copper) is tin plated, there can be obtained an effect that it can be used as the cable while the color change of the conductor (soft copper) or disconnection does not become liable to occur.

BEST MODE FOR CARRYING OUT THE INVENTION

Hereinafter, preferred embodiments of a flat-shaped cable of the invention will be described with reference to the accompanying drawings.

Figure 1:
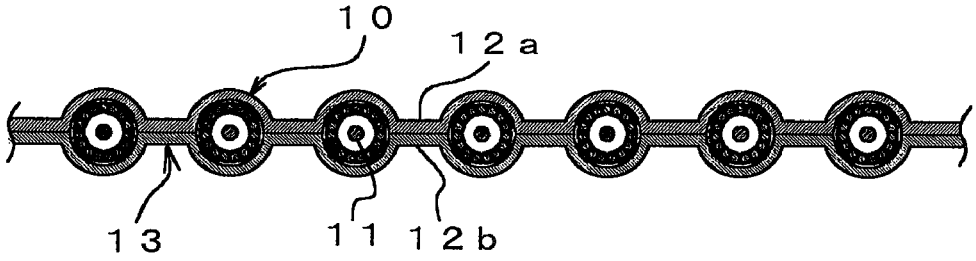
FIG. 1 is a schematic partial sectional view of a preferred embodiment of a flat-shaped cable according to the invention.

FIG. 1 is a schematic partial sectional view of a preferred embodiment of a flat-shaped cable according to the invention.

Figure 2:
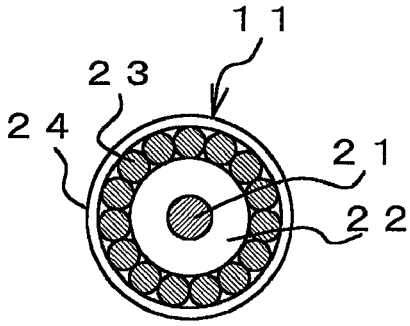
FIG. 2 is a sectional view of a coaxial cable as a transmission line used for the flat-shaped cable of the invention.

FIG. 2 is a sectional view of a coaxial cable as a transmission line used for the flat-shaped cable of the invention.

Figure 3:
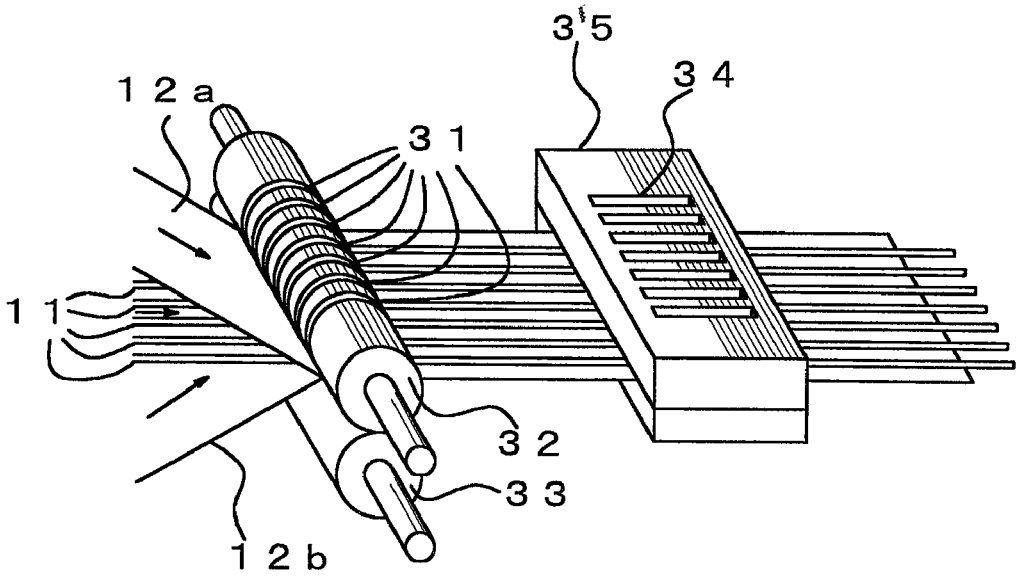
FIG. 3 is an explanatory view of a case where the flat-shaped cable of the invention is produced.

FIG. 3 is an explanatory view of a case where the flat-shaped cable of the invention is produced.

With reference to FIG. 1, a flat-shaped cable 10 of the invention is shown, and this flat-shaped cable 10 includes transmission lines 11, such as many conductors or coaxial cables, arranged side by side or in parallel to each other (although the number of the lines is seven in this embodiment, no limitation is made to this number). At both sides (the up-and-down direction in FIG. 1) of the transmission lines 11 such as the many conductors or coaxial cables, non-sintered or semi-sintered PTFE sheets or EPTFE sheets 12*a* and 12*b* are disposed as general sheaths, and in portions where these non-sintered or semi-sintered sheaths 12*a* and 12*b* are connected through the transmission lines 11 such as the conductors or the coaxial cables, that is, in web portions 13, the sheaths 12*a* and 12*b* are sintered and are joined. As a result, the respective conductors or the respective transmission lines 11 of the flat-shaped cable 10 are covered with and held between the sheaths 12*a* and 12*b*, and are firmly held and fixed at specified positions by the web portions 13 formed by sintering of the sheaths 12*a* and 12*b*.

Incidentally, in the above case, in the case where the coaxial cable is used as the transmission line, as shown in FIG. 2, this transmission line 11 is the coaxial cable in which a dielectric 22 of a fluororesin such as PTFE or tetrafluoroethylene-hexafluoropropylene copolymer (hereinafter referred to as FEP) is disposed around a center conductor 21 made of a conductor such as a silver-plated high tensile strength copper alloy, an external conductor 23 formed into a braided structure or a spiral covered structure by using plural conductor elemental wires made of tin-plated tin copper alloy is provided around the dielectric 22, and a jacket 24 made of a fluororesin such as EPTFE, PTFE or tetrafluoroethylene-hexafluoropropylene copolymer (hereinafter referred to as FEP) covers this external conductor 23. Incidentally, it is needless to say that as the transmission line, in addition to the above coaxial cable, a multi-core cable formed by twisting or bundling wires can also be used.

The flat-shaped cable 10 as stated above is produced in a manner described below. That is, as shown in FIG. 3, many conductors or transmission lines 11 (seven lines in this embodiment) are supplied into respective grooves 31 between a grooved compression roll 32 having many grooves 31 and a grooved compression roll 33 arranged at a position opposite to the grooved compression roll 32 and similarly having many grooves 31 at positions corresponding to the respective grooves 31 of the grooved compression roll 32, and the many conductors or transmission lines 11 are arranged side by side or in parallel to each other. Further, from both sides (up-and-down direction in FIG. 3) of these conductors or transmission lines 11, non-sintered PTFE sheets or EPTFE sheets 12*a* and 12*b* are respectively supplied as sheaths, and these conductors or transmission lines 11 are covered with and held between the PTFE sheets or EPTFE sheets 12*a* and 12*b* from both the sides.

At this time, portions where the non-sintered sheaths 12*a* and 12*b* are connected through the conductors or transmission lines 11, that is, web portions 13 are compressed by portions of the compression rolls 32 and 33 where no grooves exist. Thereafter, the web portions 13 in which the non-sintered PTFE sheets or EPTFE sheets 12*a* and 12*b* at both sides of the conductors or transmission lines 11 are made to pass through a sintering unit 35 having plural individual sintering machines 34 (although the number of the machines is seven in this embodiment, no limitation is made to this number) arranged above and separated from the web portions 13, so that only the portions are sintered, and the general PTFE sheets or EPTFE sheets 12*a* and 12*b* are kept in the non-sintered state or the semi-sintered state.

Here, the reason why only the web portions 13 are sintered by being made to pass through the sintering unit 35 is that each of the plural individual sintering machines 34 disposed in the sintering unit 35 has a thin and long blowing port so as to correspond to the thin width of each of the web portions 13, a hot wind of about 500° C. is blown from a not-shown heat source through this blowing port to the web portion 13, and this portion is sintered. Incidentally, by providing a change, for example, by accelerating the speed at which the web portion 13 passes through the sintering unit 35, the degree of sintering of the PTFE sheets or EPTFE sheets 12*a* and 12*b* in this portion can also be changed, and the web portion 13 can also be substantially intermittently sintered.

In the flat-shaped cable 10 of the invention formed in this way, unlike a past case, it is not performed that the whole flat-shaped cable is immersed in the high temperature sintering bath and the whole sheath is sintered in order to hold and fix the transmission lines, such as conductors or coaxial cables, of the flat-shaped cable, only the web portions 13 which are required to firmly hold and fix the transmission lines 11, such as the conductors or coaxial cables, at specified positions are sintered, and the general sheaths 12*a* and 12*b* to cover and hold the conductors or transmission lines 11 of the flat-shaped cable 10 are kept in the non-sintered state or the semi-sintered state of EPTFE or PTFE, and accordingly, the PTFE sheets or EPTFE sheets are not shrunken at the time of sintering, and a pitch between the respective conductors of the flat-shaped cable or between the respective transmission lines can be kept with sufficient accuracy.

Further, as stated above, since the general sheaths 12*a* and 12*b* are kept in the non-sintered state or the semi-sintered state of EPTFE or PTFE, the PTFE sheets or the EPTFE sheets are not hardened by sintering, and the bendability, flexibility, pliability or slidability of the flat-shaped cable can be excellently kept. Besides, the center conductor of the coaxial cable as the transmission line does not kink, and accordingly, there does not occur a problem in electric characteristics, such as poor voltage resistance or poor characteristic impedance, and there does not occur a problem that disconnection becomes liable to occur. Further, since the flat-shaped cable of the invention does not use a high temperature sintering bath, not only in the case where the conductor (soft copper) is silver plated or nickel plated, but also in the case where the conductor (soft copper) is tin plated, the color change or disconnection of the conductor (soft copper) does not become liable to occur, and it can be used as the transmission line.

Hereinafter, a description will be made on the invention while disclosing examples of the invention.

EXAMPLE 1

The center conductor 21 formed by twisting 19 silver-plated high tensile strength copper alloys each having a diameter of 0.127 mm was covered with FEP by extrusion or the like to form a dielectric layer 22 with a thickness of 0.2 mm, and the outer diameter was made 0.997 mm. As an external conductor layer 23, a spiral covered shield layer or a served wire shield layer formed of tin-plated tin copper alloys of a diameter of 0.08 mm at a shield density of 90% was provided around the dielectric layer 22, an EPTFE tape was wound around the external conductor layer 23 to form a jacket layer 24 of a thickness of 0.15 mm, and a coaxial cable 11 of an outer diameter of 3.1 mm was produced as a transmission line.

Seven such coaxial cables 11 produced in this way were supplied to the respective grooves 31 between the grooved compression rolls 32 and 33 as shown in FIG. 3, and the coaxial cables 11 were arranged side by side or in parallel to each other. Further, non-sintered EPTFE sheets 12*a* and 12*b* with a thickness of 0.12 mm were supplied as sheaths from both sides (up-and-down direction in FIG. 3) of the coaxial cables 11, and these coaxial cables 11 were covered with and held between the EPTFE sheets 12*a* and 12*b* from both the sides.

Thereafter, the web portions 13 where the non-sintered EPTFE sheets 12*a* and 12*b* at both the sides of the coaxial cables 11 were made to pass through the sintering unit 35 having the individual sintering machines 34 so that they were sintered, and further, the general EPTFE sheets 12*a* and 12*b* were kept in the non-sintered state or semi-sintered state, and the flat-shaped flat cable with a width of 25 mm and a thickness of 2.5 mm was produced.

In the flat-shaped cable 10 of the invention produced in this way, only the web portions 13 necessary to hold and fix the coaxial cables 11 at specified positions are sintered, and unlike a past case, since it is not performed that the whole flat-shaped cable is immersed in the high temperature sinter bath and the whole sheath is sintered, the general sheaths 12*a* and 12*b* are kept in the non-sintered state or the semi-sintered state of EPTFE, and accordingly, the EPTFE sheets are not shrunken, and the pitch between the respective coaxial cables of the flat-shaped cable can be kept with sufficient accuracy.

Besides, since the general sheaths 12*a* and 12*b* are kept in the non-sintered state or the semi-sintered state of EPTFE, the EPTFE sheets are not hardened by sintering, and the bendability, flexibility, pliability or slidability of the flat-shaped cable 10 can be excellently kept. Further, the center conductor of the coaxial cable does not kink, and accordingly, there does not occur a problem in electric characteristics, such as poor voltage resistance or poor characteristic impedance, and there does not arise a problem that disconnection becomes liable to occur, and in the invention, not only in the case where the conductor (soft copper) is silver plated or nickel plated, but also in the case where the conductor (soft copper) is tin plated, the color change or disconnection of the conductor (soft copper) does not become liable to occur.

INDUSTRIAL APPLICABILITY

The flat-shaped cable of the invention can be used very excellently as, for example, a flat-shaped cable to electrically connect a movable part and a fixed part of a stepper of a semiconductor manufacture apparatus, which is required to have the viewpoint of excellent electric characteristics such as a low dielectric constant, or heat resistance, chemical resistance, or out gas measure, and further, can be used as an excellent flat-shaped cable in the field in which keeping excellent bendability, flexibility, pliability or slidability of the flat-shaped cable is required, or keeping sufficiently accurate pitch between the respective coaxial cables of the flat-shaped cable is required.

The invention claimed is:

1. A flat cable comprising:

a plurality of transmission lines arranged in parallel to each other;

an upper insulating layer above the transmission lines;

a lower insulating layer below the transmission lines;

said insulating layers being formed of polytetrafluoroethylene;

a web formed between each of the transmission lines; and the upper and lower insulating layers sintered together only at each web wherein the web is intermittently sintered along the length of the cable.

2. A method for manufacturing a flat cable comprising:

providing a lower insulating layer;

providing a plurality of transmission lines;

arranging the transmission lines in parallel to each other on top of the lower insulating layer;

providing an upper insulating layer on top of the transmission lines;

creating a web between each transmission line wherever the upper and lower insulating layers are in contact with each other;

providing upper and lower compression rollers wherein at least one of the rollers has grooves sized to accommodate each individual transmission line and its insulating layers;

compressing the transmission lines and webs by passing them between the upper and lower compression rollers;

providing a sintering unit with individual sintering machines arranged to align with each web; and feeding the transmission lines and webs through the sintering unit whereby sintering only the webs wherein the web is sintered intermittently along the length of the cable.

* * * * *